US006917022B2

(12) United States Patent
Feher et al.

(10) Patent No.: US 6,917,022 B2
(45) Date of Patent: Jul. 12, 2005

(54) CONTINUOUS FLOW MICROWAVE HEATER

(75) Inventors: Lambert Feher, Linkenheim-Hochstetten (DE); Hartmut Baumgärtner, Karlsdorf-Neuthard (DE); Guido Link, Waldzbachtal (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 10/730,559

(22) Filed: Dec. 8, 2003

(65) Prior Publication Data

US 2004/0155034 A1 Aug. 12, 2004

Related U.S. Application Data

(63) Continuation-in-part of application No. PCT/EP02/05335, filed on May 15, 2002.

(30) Foreign Application Priority Data

Jun. 8, 2001 (DE) ..... 101 28 038

(51) Int. Cl.[7] ..... H05B 6/78; H05B 6/80

(52) U.S. Cl. ..... 219/687; 315/112

(58) Field of Search ..... 219/687, 695, 219/750, 640, 688, 689, 696, 697, 745, 746, 748, 749, 686; 315/112, 111.21, 39; 422/186, 21; 588/1, 227; 210/748; 204/164

(56) References Cited

U.S. PATENT DOCUMENTS 5,122,633 A * 6/1992 Moshammer et al. ..... 219/687
5,235,251 A * 8/1993 Schlie ..... 315/112
5,625,259 A * 4/1997 Holber et al. ..... 315/111.21
6,740,858 B2 * 5/2004 Tracy et al. ..... 219/687

FOREIGN PATENT DOCUMENTS

EP 0 765 105 A2 3/1997

* cited by examiner

*Primary Examiner*—Quang T. Van
(74) *Attorney, Agent, or Firm*—Klaus J. Bach

(57) ABSTRACT

In a continuous flow microwave heater for heating a fluid including a microwave source connected to an applicator so as to supply microwave energy to the applicator, the applicator is a rectangular block-like resonator space with opposite front walls and side walls with a microwave in-coupling opening in one of the side walls through which the microwave energy is supplied to the resonator space in which a linearly polarized base mode $TE_{10}$ is excited. A dielectric tube extends through the resonator space to conduct the fluid to be heated through the applicator, the dielectric tube being so arranged that the microwave energy supplied to the applicator is completely dis-sipated into the fluid flowing through the dielectric tube.

4 Claims, 2 Drawing Sheets

CONTINUOUS FLOW MICROWAVE HEATER

This is a Continuation-In-Part application of international application PCT/EP02/05335 filed May 15, 2002 and claiming the priority of German application 101 28 038.6 filed Jun. 8, 2001.

BACKGROUND OF THE INVENTION

The invention relates to a continuous flow microwave heater for heating fluids.

Microwaves are suitable for heating in many ways. They are used in food processing, in households, in the medicine and in industrial materials processing in various ways. Goods being processed may simply be irradiated or a microwave applicator may be part of a microwave power generator for heating such as the well-known household microwave oven or the microwaves may be used for heating or maintaining the temperature of a heat bath in the processing of materials.

The last mentioned is known from DE 199 35 387 A1. In this case, a microwave applicator is arranged at one side wall of a tub such that the side wall is common to the microwave applicator and the tub. The side wall consists of a lattice structure with a mesh width which does not permit passage of the microwaves but permits the liquid of the bath in the actual bath tub to be circulated through the lattice wall.

Such arrangements are relatively complicated if the microwave component and utilization component are designed as a unit. Then protective measures are necessary which, because of the small available space, require special consideration.

From each of DE 697 01 702 t2, DE 199 25 493 C1 and DE 196 06 517 C2, a microwave resonator is known through which a microwave-pervious tube extends.

DE 697 01 702 T2 discloses a method for the dissociation of polymers to monomers wherein, originally, the polymer is disposed in a quartz tube which extends through the microwave cavity which is disposed at the end of a hollow conductor system.

DE 199 25 493 C1 discloses a linear arrangement for a large area microwave treatment and for a large-area plasma generation. The arrangement comprises a hollow space resonator with an elliptic cross-section along whose one focus line a linear microwave antenna is disposed, surrounded by a dielectric, which is inert with respect to the surrounding material and which is microwave permeable. Along the second focal line, an also microwave permeable tube extends in which a part to be treated is disposed and which is exposed therein to the plasma generated by the microwave.

DE 196 06 517 C2 discloses a pressure reactor with microwave heating for continuous operation. It comprises individual cells disposed adjacent one another and equipped with microwave transmission antennas, the cells being separated by grounded separating walls. Tubes of microwave transparent material extend through the separating walls of the cell. Outside the cells the tubes become metal tubes. Within the tubes, a medium, which is conducted through the tubes, is heated by microwaves coupled in each cell into the medium flowing through the tubes. The row of cells is formed by chambers, which are clamped to-gether by anchoring bolts in a pressure and microwave-tight manner.

It is the object of the present invention to provide a technically simple arrangement for the heating of fluids by microwaves with applicators in which the microwave energy can be coupled into the fluid free of reflections or with only a tolerable amount of reflections.

SUMMARY OF THE INVENTION

In a continuous flow microwave heater for heating a fluid including a microwave source connected to an applicator so as to supply microwave energy to the applicator, the applicator is a rectangular block-like resonator space with opposite side walls and front walls with a microwave in-coupling opening in one of the side walls through which the microwave energy is supplied and in which a linearly polarized base mode $TE_{10}$ is excited. A dielectric tube extends through the resonator space to conduct the fluid to be heated through the applicator, the dielectric tube being so arranged that the microwave energy supplied to the applicator is completely dissipated into the fluid flowing through the dielectric tube.

The microwave source of the arrangement includes an uncoupling arrangement/antenna which, depending on space conditions, is flanged directly or by way of a rectangular hollow conductor to the microwave uncoupling opening in the side wall of the rectangular applicator.

The load is a dielectric tube through which the medium to be heated flows and which is installed parallel to the axis of the uncoupling opening for the microwave between two parallel side walls of the applicator and which extends with its longitudinal axis up to the respective side walls.

At the outside, a metallic tub stub is connected to each end of the dielectric tube. The two free ends are connected to a fluid flow circuit. The two tube stubs are connected to the dielectric tube in a fluid-tight manner and are microwave impervious but also mechanically connected to the respective side walls of the applicator in a sufficiently stable manner. They may be connected by soldering or welding.

The geometry of the design arrangement depends on the wavelength $\lambda$ of the microwave uncoupled from the microwave source and the formation of the linearly polarized base modes $TE_{10}$. In accordance therewith, the geometry of the applicator is determined as a rectangular hollow conductor.

The axis of the microwave uncoupling opening and the longitudinal axis of the dielectric tube extend parallel to each other and both axes extend normal to two opposite applicator walls and through their respective longitudinal center line. Both have a distance of about $\lambda/4$ from the respective nearest front side of the applicator.

The distance between the antenna and the dielectric tube is so large that the microwave coupled into the applicator is fully or almost fully dissipated in the fluid flowing through the dielectric tube. For fine tuning or fine adjustment the front side next to the load is therefore adjustable in contrast to the side near the microwave uncoupling opening, that is, it can be adjusted microwave technically to the load and consequently is a short circuit slide. This arrangement is not necessary after a corresponding load- and accordingly, material—or respectively, fluid-dependent adjustment of the distance if always only one type of fluid is to be heated.

The dielectric tube through which the fluid to be heated flows may maximally have a diameter corresponding to the distance between the applicator housing walls between which the tube is disposed. The dielectric tube extends centrally between the two applicator housing walls and vertically with respect to the other two walls which it abuts. The fluid in the dielectric tube is heated volumetrically generally not evenly over the open cross-section of the dielectric tube but essentially, in a profile, about in a sinus form, of the linearly polarized base mode $TE_{10}$, which is provided for the high-energy heating. Since the longitudinal axis of the tube coincides with the field maximum, with the amplitude of the electric field and with the polarization direction of the linearly polarized base mode $TE_{10}$, it is apparent how good the uniform heating of the medium flown through the tube is over the flow cross section; near the radial circumference, it is constant, with increasing radial distance, it drops off. The constant or drop-off behavior can be shown by the curve pattern of the linearly polarized base mode over the applicator cross-section similar to that of a sinus shaped half-wave. Near the center between two opposite side walls of the applicator, the base mode is about constant corresponding to $\sin(\pi/2)$ further outside the curve it is similar to $\sin \alpha$, for $0<\alpha<n$.

The open width of the two tube stubs extending from the respective applicator wall is at the beginning equal the outer diameter of the dielectric tube. With respect to the microwave length $\lambda$, this partial length lg is in the range of:

$$\lambda/4<lg<\lambda/2.$$

Further out, the two tube stubs have an inner diameter which decreases over a length $l_{cut\text{-}off}>1/4$, so that, dependent on the relative dielectric constant$_{ET}$ of the medium to be heated, there are cut-off conditions for the microwave that is they do not exit at this point into the environment.

The dielectric tube is not subject to minimal requirements other than that it is fluid tight. Of course, it needs to be inert with respect to the fluid to be heated. All these requirements are fulfilled by aluminum oxide, which must only be examined as to its chemical behavior that is its reaction inertness. For example, $Al_2O_3$ is almost transparent for a microwave of 700 MHz to 25 GHz, that is, there is no or very little microwave coupling and therefore no problematic heating of the dielectric tube. Such an examination is needed however for all dielectric materials considered for use as tube walls. Glass and quartz glass are therefore also suitable to name some other examples.

In an advantageous embodiment, the front wall of the applicator disposed nearest to the dielectric tube is adjustable. This is done using a short circuit slide, which however is necessary only with electrically different media. If the same medium is used, this front area as well as the opposite front area may be firmly installed.

Which type of microwave source is used in a particular case depends on the energy requirements and the frequency $\nu$ or, respectively, the wavelength $\lambda$ of the microwave. The magnetron, which is today a fully developed apparatus, is probably without competition in the energy range <10 kW. Other usable microwave sources are a klystron or a backward wave oscillator, BWO, or another technically suitable microwave tube for delivery the needed microwave energy. The rectangular hollow conductor including the applicator have a simple geometry based on the operating frequency. Basically, it is suitable for any microwave frequency as long as the corresponding powerful microwave source is available.

With the continuous flow microwave heater, polar as well as non-polar fluids can be heated in a controlled manner. Polar fluids are fluids, whose molecules have a permanent electric dipole moment such as water, acids, oleic acids or similar.

As it is well-known, electric fields can be well coupled into these fluids. The complementary group of non-polar fluids consists of molecules, which do not have a permanent electric dipole moment; they are mostly of organic nature such as acid-free oils, fats, alcohols to name just a few. With these types, the volumetric heating is important.

The continuous flow microwave heater is of simple technical design assembled completely from standard components. Microwave shielding structures toward the environment are somehow inherent since the microwave source is a component surrounded by a metal housing. It is provided with cooling ribs and a blower for cooling or with cooling ribs provided with passages connected to a cooling circuit so that a coolant can be conducted through these passages. The applicator is directly connected or it is connected by way of a short hollow conductor piece. By way of the metallic tube stubs, which are connected to the two ends of the dielectric tube, the flow circuit can be completed in a simple manner using two hose connectors.

The microwave apparatus is uncoupled from the area where the heated fluid is utilized. This means that only the microwave apparatus needs to be safely shielded toward the ambient not the utilization area such as a heat bath, a radiator, a temperature control arrangement or another heating arrangement of this type used in plants where the heated fluid is finally used. Instead of a liquid, also a gas can be heated in this way if the microwave can be coupled into the dielectric tube such that it is competitive with other heating systems.

It is also an economic advantage that, with an applicator geometry adapted to the load through which the fluid flows, a circulator as protection from waves returning to the microwave source is no longer necessary since the wave emitted by the microwave source is completely dissipated in the load and converted into heat. Such a circulator would be redundant that is it would be installed only as an additional protection device.

With a well-adapted geometry, the electromagnetic source is for example in the form of an antenna, or respectively, an uncoupling opening and the sink produces no reflections as the whole load consists of the dielectric tube with the fluid flowing therethrough. The arrangement should be so designed that the uncoupled electromagnetic energy dissipates completely or at least mostly into the fluid. With a pulse-width-controlled operation of the microwave source, the power output of the apparatus can be controlled continuously from zero to nominal power output.

Below, the invention will be described in greater detail on the basis of the accompanying drawings.

DESCRIPTION OF A PARTICULAR EMBODIMENT

The continuous flow microwave heater described below operates with a microwave frequency of $\nu$=2.45 GHz, which is equivalent to a wavelength of $\lambda\approx$12 cm in a vacuum. The geometry of the apparatus is based on these values. Two other usable ISM frequencies are for example a lower frequency of 915 MHz and a higher frequency of 5.85 GHz. Usable technical microwave sources operating at these frequencies are commercially available.

In the embodiment, which will be described below, a magnetron is used as the microwave source. It has for example the following technical data:

| | |
|---|---|
| Microwave Output Energy | 1000 W |
| Frequency | 2.45 GHz |
| Voltage | 4.2 kV |
| Current | 0.33 A |

The magnetron is usually manufactured as a unit including the cooling arrangement. At its top, the rectangular hollow conductor is open and provided with a coupling flange. Connected thereto is the applicator 1 at the front end of which, close to the uncoupling opening, an evacuation stub is arranged for an eventually needed evacuating of the apparatus. The other front end 8 of the applicator 1 is either unmovable or it is in the form of a short-circuiting slide gate 8.

Figure 1:
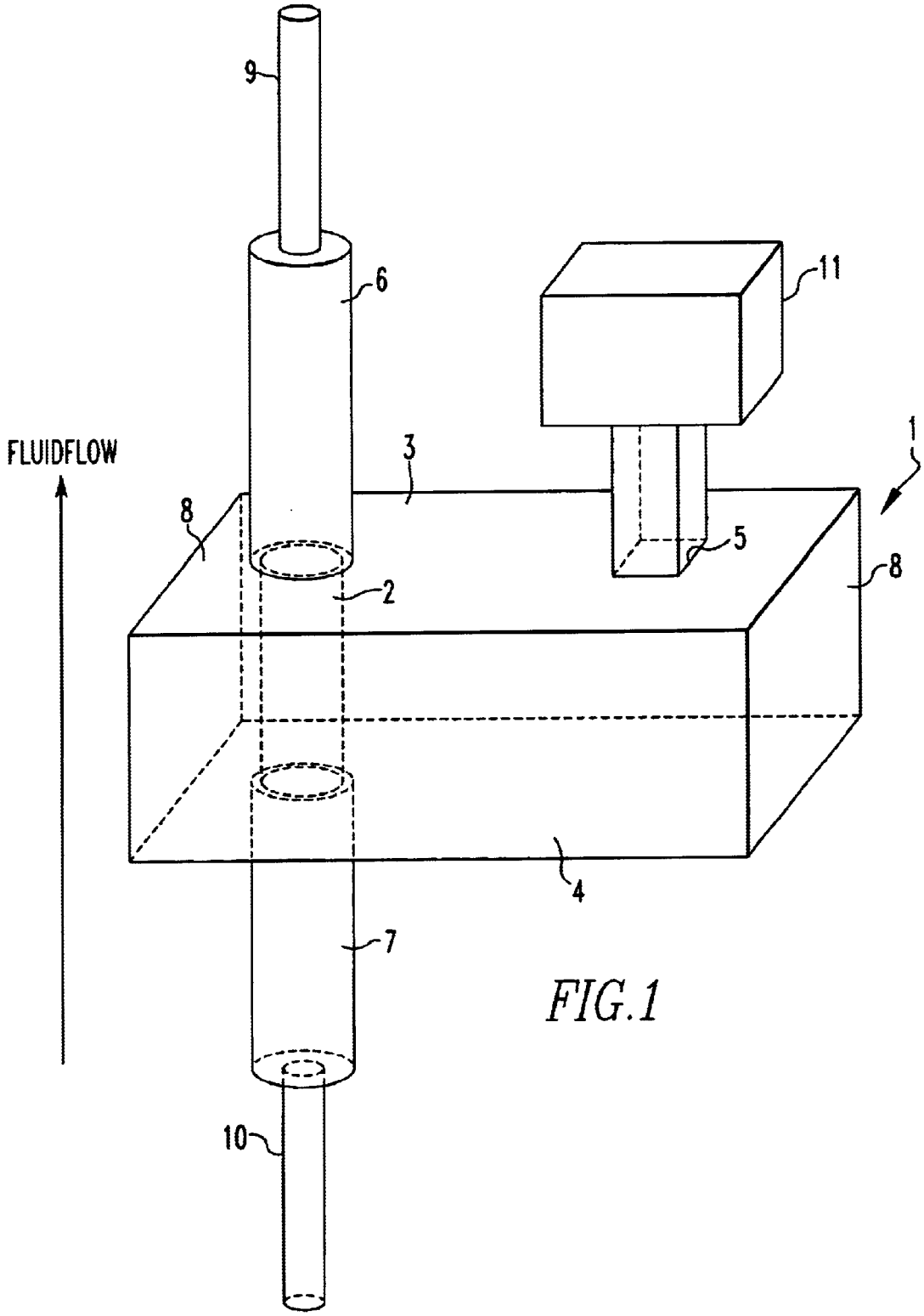
FIG. 1 shows an applicator.

FIG. 1 does not show the complete arrangement. Only the block-like applicator is shown which consists for example of aluminum. At its top wall 3, an opening 5 is provided for the in-coupling of the microwaves from a microwave source 11. Further along the longitudinal axis of the applicator, that is, in the figure toward the left, the dielectric tube 2 is shown extending between the top wall 3 and the bottom wall 4 of the applicator. In this case, the dielectric tube consists of $Al_2O_3$. At its one end at the top side 3, the metallic shielded discharge tube 6 is connected to the tube 2 and at the other side 4, the metallic shielded supply tube 7 is connected to the tube 2. Hoses 9 and 10 are connected to the discharge and supply tubs 6 and 7 of the circuit.

Figure 2:
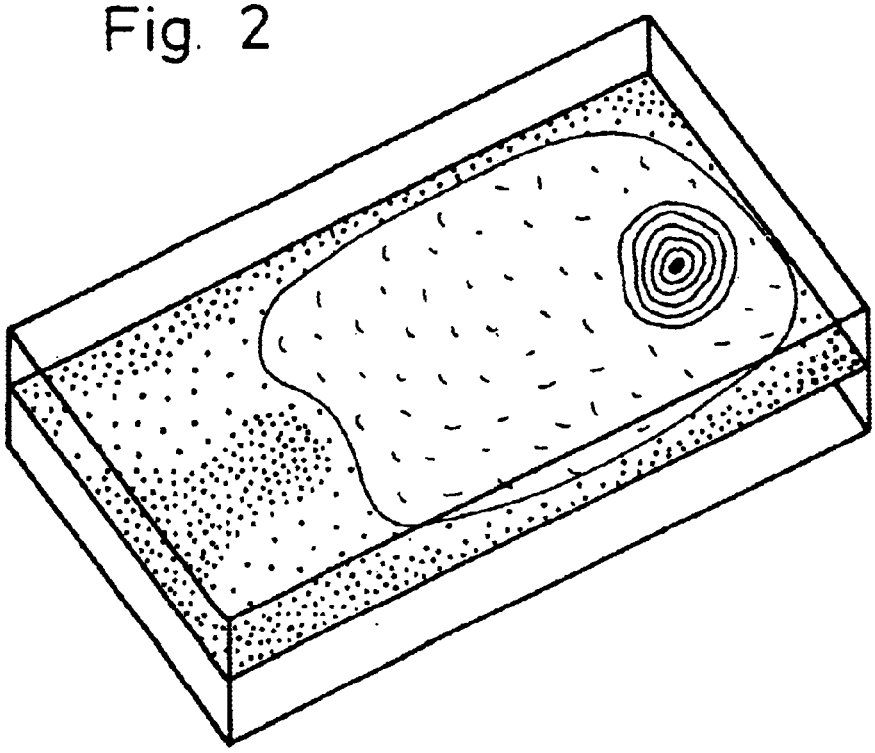
FIG. 2 shows the intensity distribution in a charged applicator which is tuned.
Figure 3:
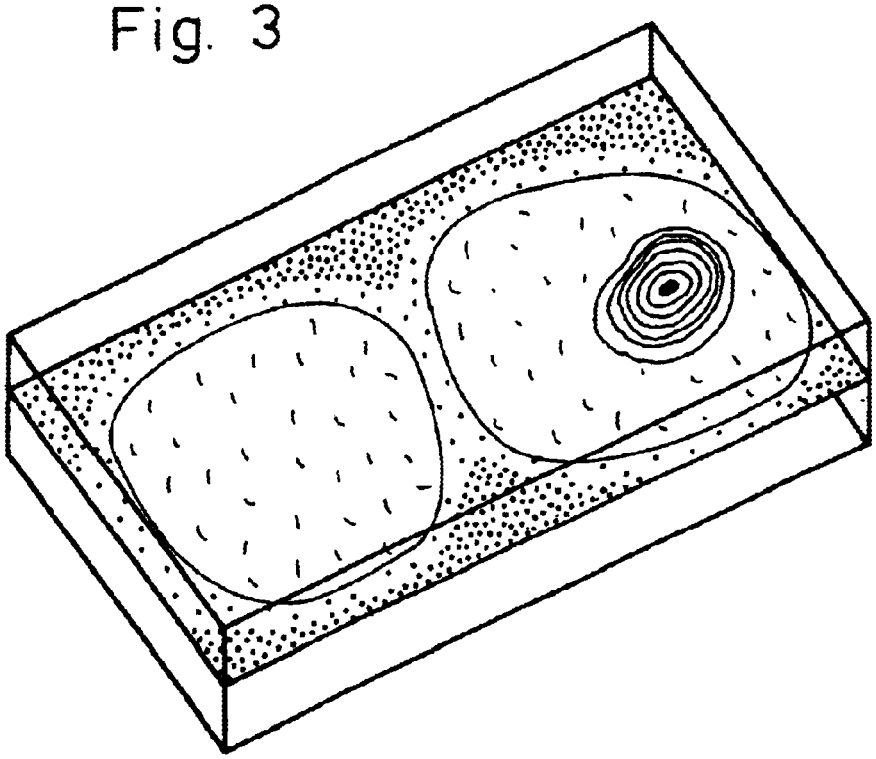
FIG. 3 shows the intensity distribution in an empty applicator.

FIG. 2 shows the electromagnetic applicator 1 with a geometry tuned to a loss of load on the center plane of the applicator 1, which extends parallel to the uncoupling plane, that is, fluid flows through the applicator 1 and, respectively, the dielectric tube 2. Near the upper right front wall—as shown in the FIG.—the $\lambda/4$ distance≈3 cm, there is the source, that is, the uncoupling of the microwave energy with an originally high energy density relative to an area further inside in the applicator 1. Near the—as shown in the figure—left front wall 8, in the load-dependent $\lambda/4$ distance therefrom the electromagnetic energy disappears, $\alpha$ is volumetrically dissipated into the flowing load that is it is converted into heat energy. In this case, there are no reflections/resonances in the applicator; the microwave is completely sucked up by the load. For a clear comparison, FIG. 3 shows the load-free condition, where there are reflections/resonances in the applicator. This resonance case should be avoided since, without circulator between the microwave source, that is the magnetron, and the uncoupling opening 5 in the applicator 1, the microwave source may be damaged by back coupling. Generally, the back coupling into a microwave source must be avoided by adaptation or it must be reduced to a tolerable amount by protective measures such as a circulator.

The subassembly of the standard microwave components, that is, the microwave source with its cooling system in the form of a blower or in the form of a heat exchanger coupled thereto so as to remove heat therefrom and the power supply with control and switching arrangements, is not shown since these are commercially available components and it is sufficient for an explanation of the invention to show the uncoupling opening 5 of the applicator 1. This is where the uncoupling opening of the microwave source 11 is in communication directly, or indirectly by way of wave guide, with the applicator 1. Further technical devices for supervising-, protection-, and control purposes are also not shown in the FIG. 1 to facilitate the understanding of the invention as such.

What is claimed is:

1. A continuous flow microwave heater for heating fluids, comprising:

a microwave source, an applicator (1) having opposite front walls (8) and side walls (3, 4) with a microwave in-coupling opening (5) connected to said microwave source (11) directly or by way of a hollow conductor, a dielectric tube (2) extending through said applicator (1) parallel to the axis of said microwave in-coupling opening (5) in said applicator (1) and normal to two opposite side walls (3, 4) of said applicator (1), of which one includes said in-coupling opening (5), a metallic tube stub (6, 7) sealingly connected to each of opposite ends of said dielectric tube (2) outside said applicator (1) for conducting a fluid to be heated through said applicator (1), which fluid forms a load (2), said tube stubs (6, 7) being also joined to said opposite side walls (3, 4) of the applicator (1) in a microwave-tight manner, wherein said applicator (1) has a rectangular shape which is adapted to the wavelength $\lambda$ of the microwave supplied by the microwave source (11) in such a way that, in the applicator (1), the linearly polarized base mode $TE_{10}$ of the microwave is excited, the axis of said dielectric tube (2) extends parallel to the field polarization of the linearly polarized $TE_{10}$ mode and is disposed at a distance of about $\lambda/4$ from the respective nearest front wall (8) of said applicator (1), and the axis of the dielectric tube (2) coincides with the field maximum of the linearly polarized $TE_{10}$ mode, the distance between the center point of the incoupling opening (5) and the axis of the dielectric tube (2) is so selected that field energy coupled into the applicator (1) is completely or nearly completely absorbed in the dielectric tube (2) through which the fluid to be heated is conducted and converted therein to heat, such that no or only negligable reflections occur in the applicator, and said tub stubs (6, 7) have an open width adjacent the side walls (3, 4) of the applicator (1), which equals the outer diameter of the dielectric tube (2) over a length of $\lambda/4$ to $\lambda/2$, and their diameter becomes then smaller over a length of $>\lambda/4$ so as to provide a blocking structure preventing an escape of any microwaves from said applicator (1).

2. A continuous microwave heater according to claim 1, wherein said dielectric tube (2) consists of a material, which is inert with respect to the fluid conducted therethrough.

3. A continuous microwave heater according to claim 1, wherein said front wall (8) of said applicator (1) nearest to said dielectric tube (2) is adjustable along the longitudinal axis of said applicator (1) for generating said base mode $TE_{10}$.

4. A continuous microwave heater according to claim 3, wherein, based on the required nominal power output, as said microwave source, one of a magnetron, a klystron and a backward-wave oscillator is selected.

* * * * *